US006029270A

United States Patent [19]

Ost et al.

[11] Patent Number: 6,029,270

[45] Date of Patent: Feb. 29, 2000

[54] MODULAR, ALL SEASON MULTI-COMPARTMENT CLOTHING WITH BULLET-PROOF FEATURES

[76] Inventors: Lynn Van Ost; Karen R. Manfre, both of 2 Riverview Dr., West Trenton, N.J. 08628

[21] Appl. No.: 09/249,684

[22] Filed: Feb. 12, 1999

[51] Int. Cl.[7] ..... F41H 1/02

[52] U.S. Cl. ..... 2/2.5

[58] Field of Search ..... 2/2.5; 428/911

[56] References Cited

U.S. PATENT DOCUMENTS

| | | | |
|---|---|---|---|
| D. 251,936 | 5/1979 | Shaw | D2/184 |
| 3,611,444 | 10/1971 | Rector | 2/247 |
| 4,041,549 | 8/1977 | Atkinson | 2/94 |
| 4,158,892 | 6/1979 | Gonzales | 2/69.5 |
| 4,261,059 | 4/1981 | Spitz | 2/108 |
| 4,347,629 | 9/1982 | Itoi | 2/108 |
| 4,470,155 | 9/1984 | Maeshima | 2/108 |
| 4,554,682 | 11/1985 | Hillquist | 2/70 |
| 4,569,089 | 2/1986 | Nesse | 2/108 |
| 4,843,647 | 7/1989 | Phillips, Sr. et al. | 2/69 |
| 4,864,656 | 9/1989 | Neese | 2/97 |
| 5,054,127 | 10/1991 | Zevchak | 2/247 |
| 5,063,614 | 11/1991 | McSheffery | 2/94 |
| 5,072,456 | 12/1991 | Elin | 2/94 |
| 5,077,838 | 1/1992 | Senser | 2/69 |
| 5,201,075 | 4/1993 | Svetich | 2/108 |
| 5,431,318 | 7/1995 | Garcia | 224/192 |
| 5,697,098 | 12/1997 | Miguel-Bettencourt et al. | 2/2.5 |
| 5,718,000 | 2/1998 | Ost et al. | 2/69 |

*Primary Examiner*—John J. Calvert
*Assistant Examiner*—Robert H. Muromoto, Jr.
*Attorney, Agent, or Firm*—Kenneth P. Glynn

[57] ABSTRACT

A multi-compartment, modular jacket includes a vest which has a vest front panel, a vest rear panel, a pair of armholes and a fastener for opening the vest. A plurality of pockets covers the outer surface of the vest. The vest has a fastener for releasably attaching a pair of detachable sleeves to the pair of armholes. The inner jacket has a front panel a rear panel, a pair of sleeves and a means for opening the inner jacket. The outer jacket has a jacket front panel, a jacket rear panel, a first pair of sleeves and a fastener for opening the outer jacket. A third plurality of pockets cover the external and the internal surfaces. The outer jacket has a collar which has a removable hood. At least one component of the modular jacket contains flexible body armor. The vest, the inner jacket and the outer jacket may be worn in various combinations depending upon the weather, the needs of the user and the particular body armor material configurations.

11 Claims, 4 Drawing Sheets

MODULAR, ALL SEASON MULTI-COMPARTMENT CLOTHING WITH BULLET-PROOF FEATURES

BACKGROUND OF THE INVENTION

1. Field of the Invention

The present invention relates in general to jackets having all year usability. Specifically, the present invention provides a multi-functional jacket which has three separate layers and is convertible between an outer jacket, an inner jacket, a trainer's vest and a combination of all three layers. More specifically, each jacket type has multiple pockets for the holding of various items.

2. Information Disclosure Statement

The following patents describe jackets which attempt to provide all season wear and try to provide multi-purpose and multi-functional features.

U.S. Pat. No. Des. 251,936 to Ted G. Shaw describes a combined jacket with a detachable backpack.

U.S. Pat. No. 3,611,444 to Carl T. Rector describes a combination with an article of wearing apparel having a hooked fabric secured thereto, a detachable pocket comprising a pair of substantially parallel sides peripherally joined with a substantially continuous seam and having a slit formed through one side, the slit providing access into the pocket, said one side having an exterior woolly surface that engages the hooked fabric to detachably join the pocket to the article of wearing apparel.

U.S. Pat. No. 4,041,549 to Paul Ray Atkinson describes a vest formed of flexible panels that adjust to the contour of the wearer, pocket support and shape stiffening structures are provided so that the pockets may adjustably yet firmly be located or removed and also, when in place, conform to the curved contours of the worn garment panels while providing rigidity of shape, dimension and conformance to body contour.

U.S. Pat. No. 4,158,892 to John A. Gonzales describes a sleeping bag which is convertible into different garments; and which includes front and rear panels that can be zipped together in variable ways, and the device additionally includes a pair of foot warmers, a pair of gloves and a belt.

U.S. Pat. No. 4,261,059 to Louis Spitz describes an insulation-filled jacket which has removably fastened sleeves, and retaining means for attaching the sleeves, when removed, to the inside of the jacket thereby increasing the depth of insulation over substantial surface areas of the jacket. The retaining means are positioned to hold the sleeves so as to maximize the surface area of the sleeves presented, and the depth of insulation afforded to the wearer at critical heat loss locations of his body, in order to minimize critical heat loss and to retard hypothermia. The retaining means may include fastening components constructed integrally with the removable sleeves.

U.S. Pat. No. 4,347,629 to Toru Itoi discloses a new combination garment which is useful both as a jacket and a bag having a trunk portion for covering the upper half of a human body, and formed with an opening through which a human head passes, sleeve portions through which both arms extend sideways and a head portion detachably secured to the trunk portion, in which the human head is received. When using the trunk portion as a bag, the sleeve portions are received in the trunk portion so that any part of the sleeve portions which does not protrude outside and the openings through which the arms and head pass are closed. The first opening is formed at the joint between the trunk portion and sleeve portion so that the latter is received in the former through the first opening. The first opening can be closed by means of a fastener which is operated after receiving the sleeve portions in the trunk portion. In the meanwhile, the second opening is formed at the joint between the trunk portion and head portion and can be closed by a hook device. When the trunk portion is filled with small-sized goods, it is carried with the both first and second opening closed.

U.S. Pat. No. 4,470,155 to Seiichi Maeshina describes a jumper which is convertible to a thick type or thin type jumper by detachably attaching a liner therein. Said jumper having a front and back panels and a pair of sleeves extending from the panel, which comprises: a right side constituting an outer face of the front and back panels and sleeves; a lining constituting an inner face of the front and back panels and sleeves, said lining being stitched to the right side at its peripheral edge of the panel so as to form a space between the right side and the lining, said lining having, at the back panel, a slit which communicates to the space; and a liner detachably attached in the space through the slit. The liner can be stably fixed in position in the space by a plurality of snap fasteners and loops provided at cuffs of the liner. Said jumper is excellent in the cold-proof and the water-proof.

U.S. Pat. No. 4,554,682 to Paul A. Hillquist describes a convertible jacket comprising a sleeveless body garment in the general form of a vest and an upper component comprising, as a unit, two sleeve portions connected by a yoke portion incorporating a neckhole and, optionally, a neckhole extension such as a collar or hood. The yoke portion of the upper component is so configured as to substantially cover the upper back and shoulder area of the body. The upper component, when combined with the vest, forms a selectively convertible jacket providing a second layer of construction upon the upper back and shoulders, minimum restriction of arm and shoulder movement and positive body ventilation. The upper component can be readily oriented to and attached to the vest by fastener means and can be readily detached and removed from the vest. Such attachment or removal may be effected without regard to whether the vest is being worn.

U.S. Pat. No. 4,569,089 to Gary E. Nesse describes a garment which converts from a jacket to a vest and vice versa. The garment has retractable sleeves which are rolled or folded into sleeve storage compartments which encircle the arm holes. In one embodiment, the sleeves have a longitudinal slit which runs the length thereof to facilitate folding for storage in the compartment. The garment has a retractable hood which stores in a hidden compartment in the collar. The garment has one or more retractable safety panels which can be colored international orange and/or have enhanced light reflective properties. The safety panels cover a substantial portion of the back of the garment when in use. The garment has a day pack as an integral part thereof. The garment has means to adjust the fit around the midsection of the torso by constriction of the garment.

U.S. Pat. No. 4,843,647 to James G. Phillips, Sr. et al. describes a cold weather system for keeping a wearer comfortable in a temperature of about −60° F.–+40° F. and winds up to 100 miles per hour, which utilizes a shirt, pants, parka and wind shirt and wind pants. A sleeping bag and moisture handling pad/deicing cloth are compressed in compressor bags and easily transported by the wearer for comfort during sleeping too, and used with a bivvy sack having a tent flap. The shirt and pants are ventable so that they provide comfort over a wide temperature range, the vents being completely closed when maximum thermal protection is desired. The parka includes a windskirt which engages the wearer's legs. The wind garments are made of fine denier 100% synthetic material tightly woven so that they have very low air porosity. The parka and wind shirt can be connected together to provide an emergency bivac sleeping bag. The shirt, pants and parka include an inner fabric of 100% synthetic material, an inner layer of foam at least ⅛ inch thick, and up to about one inch thick, and an outer shell of low porosity, but high moisture vapor transmission material. Portions of the shirt and pants that will be vented also include a fabric covering the insulation, the insulation covering fabric having very high air porosity.

U.S. Pat. No. 4,864,656 to Gary E. Nesse describes a removable insert assembly which is used in combination with the jacket/vest or other types of jackets to provide thermal insulation during cold weather. The left sleeve insert and the right sleeve insert are also used in combination with the jacket/vest or other types of jackets to provide complete thermal protection to the wearer. In alternative embodiments the insert assembly and sleeve inserts can be manufactured from ballistic cloth or other suitable material to provide removable body armor to the jacket/vest or other types of jackets. In another alternative embodiment the insert assembly and sleeve inserts can be manufactured to serve as a personal flotation device when installed inside of the jacket/vest or other jackets. In another alternative embodiment a Mae West type life preserver can be used in conjunction with the jacket/vest or other types jackets to function as a personal flotation device.

U.S. Pat. No. 5,054,127 to Eric Scott Zevchak describes a system of interchangeable pockets. The system generally comprises a plurality of base pads attached to articles of clothing and a plurality of interchangeable pockets. The pockets of the system are made interchangeable by attaching a first type of fastening material to the back of each pocket and a corresponding second type of fastening material to each base pad.

U.S. Pat. No. 5,063,614 to Kenneth E. McSheffery describes a reversible fishing garment, preferably in the form of a vest, having front and rear torsal portions which are substantially identical in construction and selectively accessible by the wearer. Both the front and the rear torsal portions include exterior flaps attached to the left and right sides thereof. Each of the flaps opens outwardly from the wearer's body to expose a plurality of easily accessible clear plastic pockets that are detachably secured to interior surfaces of the flaps. The detachability of the clear plastic pockets permits the wearer to modify the vest by fitting the flaps with pockets of predetermined sizes to suit the wearer's needs. The clear plastic of the pockets provides unhindered visibility of the fishing gear carried within the pockets. The provision of the pocket-carrying flaps on both the front and rear torsal portions of the vest dramatically increases the versatility, the number of pockets and the storage space that is available to the wearer in relation to fishing vests of conventional construction.

U.S. Pat. No. 5,072,456 to Lewis R. Elin describes outerwear garments for use by emergency medical services personnel particularly in cold weather months which are provided with an exterior tool holster panel positioned on the exterior of the front of the garment. The tool holster panel includes a plurality of pockets each adapted to receive a piece of emergency medical equipment. Each pocket has a top opening which permits the item to be easily introduced and removed through the top opening in use. The tool holster panel is hingedly connected to a front panel of the garment so that its bottom edge is free to swing outwardly to thereby maintain the vertical alignment of the pockets when the wearer bends over a victim in use. The top hinged connection of the tool holster panel to a breast portion of the jacket prevents the contents of the pockets from being spilled in use and maintains the items within ready visual and manual access of the wearer. The usual bulkiness of winter weight coats or other garments do not interfere with these visual and manual access provided by the front mounted tool holster panel.

U.S. Pat. No. 5,077,838 to Dane E. Senser describes a convertible, outerwear garment comprising a sleeveless vest with a jacket having sleeves attached to the interior of the vest at a pouch or pocket formed along a lower edge of the jacket. Panels at the sides of the jacket may be joined to the side of the pouch to complete the jacket structure. The jacket may be inserted into a pouch pocket when the vest is worn without the jacket. The jacket may be deployed from the pouch and the jacket sleeves inserted through the side openings in the vest, the jacket mode to provide added protection to the wearer. In this mode, the lower side panels of the jacket are secured at the side of the pouch. Another pocket may be provided in the rear of the vest to receive a rain cape or poncho which may be deployed by the user for additional wet weather protection.

U.S. Pat. No. 5,201,075 to Ronald J. Svetich describes an athlete's arm jacket which includes a first shell portion for covering one side of the upper torso of a person wearing the jacket. A sleeve is secured to the shell portion for covering one arm. A mesh covers the opposite side of the upper torso, and a second shell portion is detachably secured to the first shell portion. Another sleeve is attached to the second shell portion. The jacket may be worn and used as a traditional jacket, or one shell portion may be detached so that only one arm, shoulder and one side of the upper torso of the body are covered.

U.S. Pat. No. 5,718,000 to Lynn Van Ost et al. describes a multi compartment, modular jacket includes a vest which has a vest front panel, a vest rear panel, a pair of armholes and a fastener for opening the vest. A plurality of pockets covers the outer surface of the vest. The vest has a fastener for releasably attaching a pair of detachable sleeves to the pair of armholes. The inner jacket has a front panel, a rear panel, a pair of sleeves and a means for opening the inner jacket. The exterior surface of the rear panel has a pouch. A plurality of pockets covers the pouch and the exterior surface. The inner jacket has a collar which contains a collapsible hood. A first composite jacket is formed by fastening the vest to the inner jacket. The first composite jacket has an outside surface which is the exterior surface and an inside surface which is the outer surface. The outer jacket has a jacket front panel, a jacket rear panel, a first pair of sleeves and a fastener for opening the outer jacket. A third plurality of pockets cover the external and the internal surfaces. The outer jacket has a collar which has a removable hood. A second composite jacket is formed via a fastener which extends around an outer seam of the first composite jacket and of the outer jacket.

Notwithstanding the prior art, the present invention is neither taught nor rendered obvious thereby.

SUMMARY OF THE INVENTION

A multi-compartment, modular jacket includes a vest which has a vest front panel, a vest rear panel, a pair of armholes and a fastener for opening the vest. A plurality of pockets covers the outer surface of the vest. The vest has a fastener for releasably attaching a pair of detachable sleeves to the pair of armholes. The inner jacket has a front panel, a rear panel, a pair of sleeves and a means for opening the inner jacket. The exterior surface of the rear panel has a pouch. A plurality of pockets covers the pouch and the exterior surface. The inner jacket has a collar which contains a collapsible hood. A first composite jacket is formed by fastening the vest to the inner jacket. The first composite jacket has an outside surface which is the exterior surface and an inside surface which is the outer surface. The outer jacket has a jacket front panel, a jacket rear panel, a first pair of sleeves and a fastener for opening the outer jacket. A third plurality of pockets cover the external and the internal surfaces. The outer jacket has a collar which has a removable hood. A second composite jacket is formed via a fastener which extends around an outer seam of the first composite jacket and of the outer jacket. At least one component of the modular jacket contains flexible body armor.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
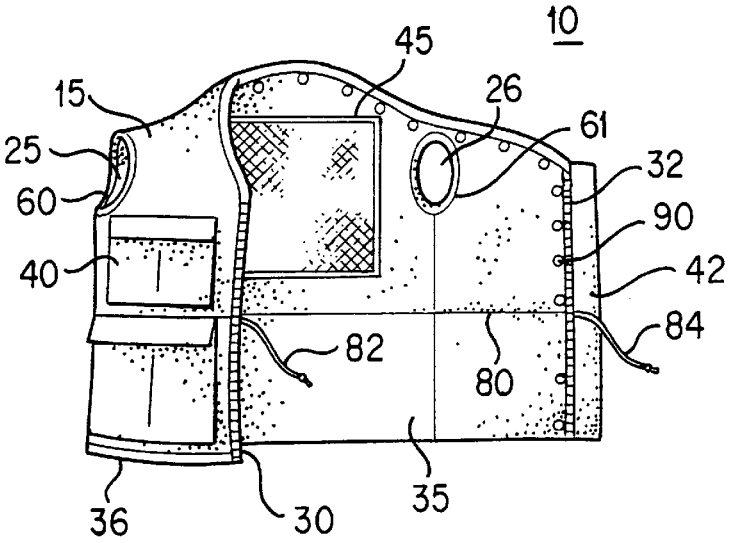
FIG. 1 shows a front view of an embodiment of the vest layer of the present invention.

The present invention is an all season modular, multi-compartment clothing with unique body armor material aspects. In one embodiment, the clothing has three layers, namely, an outer jacket, an inner jacket and a vest with detachable sleeves. The layers can be worn separately or in combination with each other. For example, the vest can be used during the summer for hiking, fishing, as a sports trainer's vest and other similar activities. The vest can then be modified by adding the detachable sleeves so that the user can use it during spring on those cool but pleasant days. The inner jacket, either separately or in combination with the vest, can be used as a windbreaker for cool, windy days or rainy, blustery days during the fall months. Finally, the outer jacket, either separately or in combination with the others, can be used during cold, wintery days. The three layer construction provides added warmth and flexibility in use. Each layer of the clothing has a plurality of pockets which can be used by the user to store a multitude of items.

As stated, the clothing consists of three layers, which can be worn concurrently or separately. The vest can be attached to the inner jacket by a fastener which extends around the entire outer seam of both the vest and the inner jacket. In making the attachment, the vest is turned inside out, and then attached to the inner jacket. As such, the resulting composite jacket has pockets on both the inside and outside. The composite jacket or the inner jacket is also attachable to the outer jacket by a continuous fastener, which extends around the entire outer seam of the medium weight or inner and outer jackets, including the neck opening. This continuous fastener ensures the warmest possible seal between the two or three layers. This final composite jacket would also have pockets on the outside and the inside.

In one embodiment, the inner and outer surfaces of each of the layers have detachable pockets. That is, each individual layer has a plurality of inner and outer removable pockets which are located around the entire surface of each of the layers. The pockets are removably attached so that the user can replace a large single pocket with a plurality of smaller pockets and vice versa.

In other embodiments, the outer jacket has a detachable apron which extends from the back side downwardly to provide added wet weather protection. In addition, the outer jacket has a detachable hood and the inner jacket has a collar which contains a collapsible hood.

In one embodiment, the present invention accomplishes the above functionality and corrects the defects of past devices by providing a multi-compartment, modular jacket which includes a vest which has a vest front panel, a vest rear panel and a pair of armholes. The vest front panel has a first means for opening the vest. The vest front panel and the vest rear panel each have an inner surface and an outer surface. A first plurality of pockets cover the outer surface of the vest front panel and the vest rear panel. The vest further included a means for releasably attaching a pair of detachable sleeves to the pair of armholes. The inner jacket has a front panel, a rear panel and a pair of sleeves. The front panel has a second means for opening the inner jacket. The front panel and the rear panel each has an interior surface and an exterior surface. The exterior surface of the rear panel has a pouch. A second plurality of pockets covers the pouch and the exterior surface of the front panel and the rear panel. The inner jacket has a collar which has a means for containing a collapsible hood. The vest has a means for fastening and the inner jacket has a complementary means for fastening the vest to the inner jacket to form a first composite jacket. The first composite jacket has an outside surface and an inside surface, wherein the outside surface is the exterior surface of the front panel and the rear panel and the inside surface is the outer surface of the vest front panel and the vest rear panel. The outer jacket has a jacket front panel, a jacket rear panel and a first pair of sleeves. The jacket front panel has a third means for opening the outer jacket. The jacket front panel and the jacket rear panel each has an internal surface and an external surface. A third plurality of pockets cover the external and the internal surface of the jacket front panel and the jacket rear panel. The outer jacket has a first collar which has a means for removably attaching a hood. It further has a means for enclosingly fastening the outer jacket to the first composite jacket to form a second composite jacket. The means for enclosingly fastening has a first member extending around an outer seam of the first composite jacket and a complementary second member extending around an outer seam of the outer jacket. The second composite jacket has an innermost surface and an outermost surface, wherein the innermost surface is the outer surface of the vest front panel and the vest rear panel and the outermost surface is the external surface of the jacket front panel and the jacket rear panel.

The present invention is a three piece all season clothing garment which is convertible between three layers, namely, a vest with or without sleeves, an inner jacket and an outer jacket. Furthermore, the vest can be combined with the inner jacket to create a first composite jacket. The first composite jacket can then be combined with the outer jacket to create a second composite jacket. As such, the clothing garment can be worn with all three layers connected or in a single layer fashion. This triple layer attachability provides greater flexibility in use during the entire year. Each layer has a plurality of pockets which cover both the front and back of the individual layer. In combination form, the garment has pockets lining the inside and outside surfaces. The pockets may be detachable. Additionally, at least one component of the modular jacket contains flexible body armor.

The vest and the inner jacket are joined using fasteners which extend along the outer seam of the vest and inner jacket. The inner jacket and outer jacket are joined via a continuous fastener which runs along the outer seam of the inner jacket and outer jacket, including the neck portion. This provides the most complete enclosability to the user and helps in retaining and maintaining the thermal comfort of the user.

Bullet proof vests, technically known as protective vests with body armor, have been in use for decades. However, these vests have been stand alone pieces of clothing and have not included multiple layering detachable components, nor have they included detachable, bullet proof sleeve protection, as in the present invention. The flexible body armor material used in the present invention may be any such fabric which is currently or which becomes available, and various choices of such fabric are not only commercially available, but are well within the purview of the artisan. Samples of such body armor materials are described in detail in some of the aforesaid cited prior art and need not be repeated herein.

Figure 2:
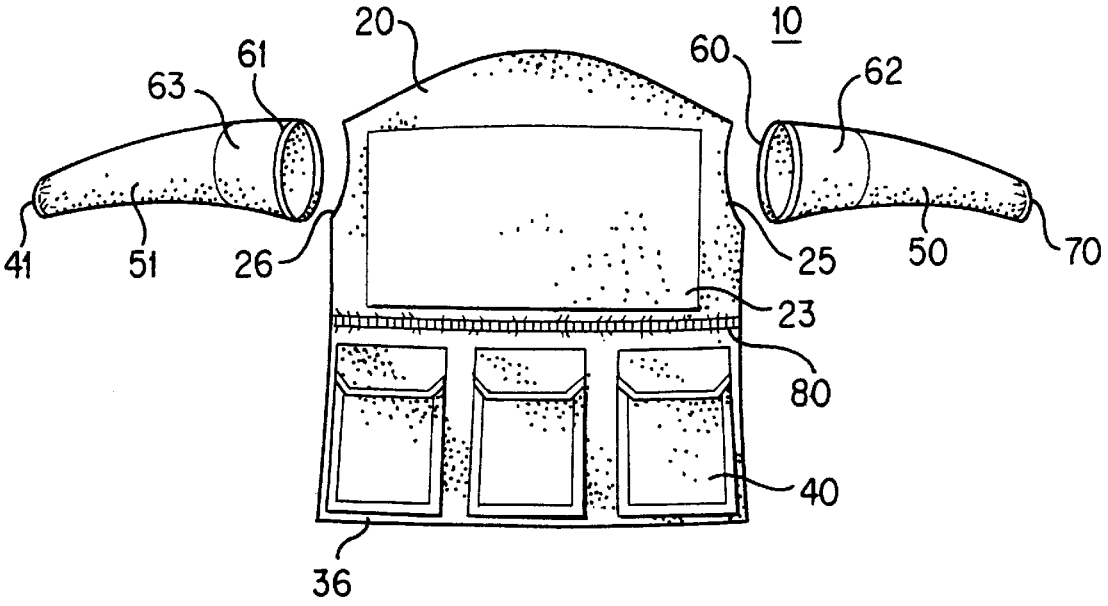
FIG. 2 shows a back view of the vest embodiment shown in FIG. 1.

Referring to FIGS. 1 and 2, a front and rear view of a vest 10 is shown. Vest 10 has a front panel 15, a rear panel 20 and a pair of armholes 25 and 26. Front panel 15 has a fastener 30 for opening and closing vest 10. Fasteners 30 and 32 can be a zipper, filamentary loop and hook mechanisms, or other similar attachment mechanisms. Front panel 15 and rear panel 20 further have an inner surface 35 and an outer surface 36. A plurality of pockets 40 cover outer surface 36. Pockets 40 are of assorted sizes, namely, small, medium and large and are opened/closed using conventional closure mechanisms. Pockets 40 may be of the detachable type. As such, the user can modify the carrying capacity of vest 10 easily and without having to change garments or carry extra jackets. Since vest 10 is more likely to be worn during warmer weather, a mesh panel 45 is provided on rear panel 20. A flap 23 overlays mesh panel 45 to provide protection. There is also an extension flap 42 which covers fastener 32 and thus covers both fasteners 30 and 32 when vest 10 is closed. The inner surface 35 of vest 10 including extension flap 42, is formed of body armor material, and, in some preferred embodiments, the inner surface of flap 23 is formed of body armor material. Alternatively, any of the foregoing body armor material inner surfaces could be replaced or enhanced by outer surface body armor material, without exceeding the scope of the present invention. In yet another embodiment, the front panel 15 alone may have inner and/or outer body armor material.

If needed, a pair of detachable sleeves 50 and 51 can be attached at arm holes 25 and 26, respectively. Detachable sleeves 50 and 51 are attached to armholes 25 and 26 via fastening mechanism 60 and 61. Fastening mechanisms 60 and 61 are preferably implemented using filamentary loop and hook mechanisms and/or zippers. However, other attachment mechanisms can be used. Detachable sleeves 50 and 51 have elastic cuffs 70 and 71 for better fit. A drawstring 80, having ends 82 and 84, is also provided to obtain a tighter and better fit. These sleeves may optionally, and in preferred embodiments, do contain flexible body armor material for additional protection. Upper arm sections 62 and 63, if unprotected, would expose shoulders, armpits and side-chest-heart-lung shot exposure to ballistic piercing if left unprotected. Thus, in some preferred embodiments, upper arm sections 62 and 63 are formed, or include, body armor material to limit bullet entry from the upper side shot area to vital organs of the wearer.

Figure 3:
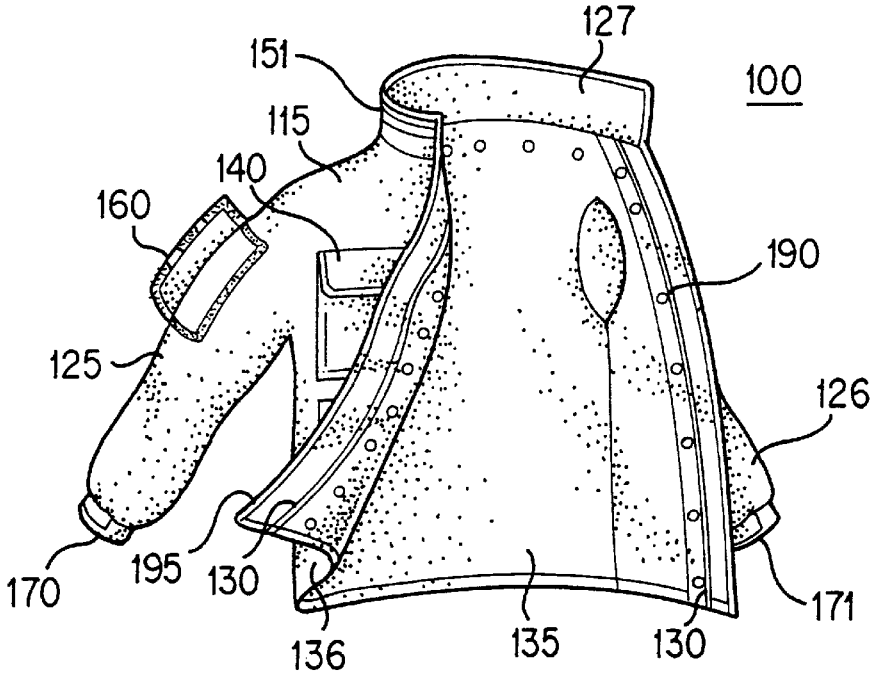
FIG. 3 shows a front view of an embodiment of an inner jacket of the present invention.
Figure 4:
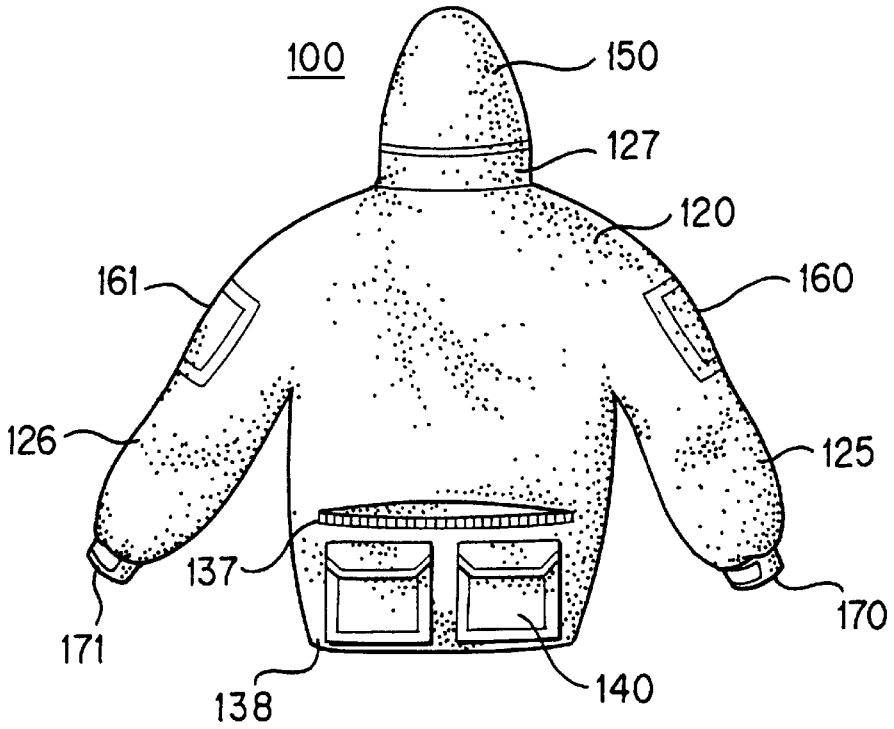
FIG. 4 shows a rear view of the embodiment shown in FIG. 3.
Figure 5:
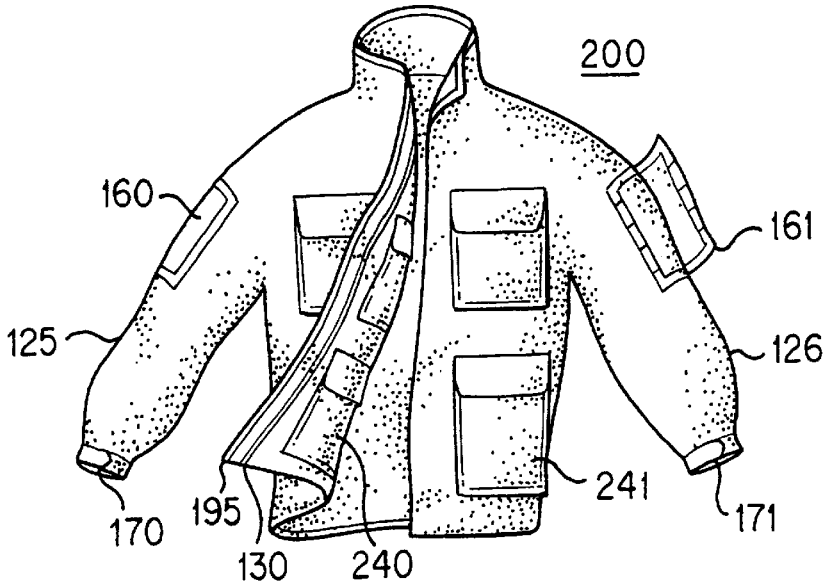
FIG. 5 shows a front view of an embodiment of a combined vest and inner jacket of the present invention.

As mentioned above, vest 10 can be attached to an inner jacket 100 (as shown in FIGS. 3 through 5). This is preferably accomplished using complementary attachment mechanisms such as snaps 90 and will be detailed below. Filamentary loop and hook mechanisms and other such fastening devices can also be used.

Referring now to FIGS. 3 and 4, a front view and rear view of inner jacket 100 is shown. Inner jacket 100 has a front panel 115, a rear panel 120, a pair of sleeves 125 and 126 and a collar 127. Front panel 115 has a fastener 130 for opening and closing inner jacket 100. Front panel 115 and rear panel 120 further have an inner surface 135 and an outer surface 136. Outer surface 136 of rear panel 120 has a pouch 137 which provides additional storage capacity. A plurality of pockets 140 cover outer surface 36 and pouch 137. That is, pouch 137 and pockets 140 form a double pocket combination. More storage area is provided by placing a pair of pockets 160 and 161 on sleeves 125 and 126, respectively. Pockets 160 and 161 are accessed from the side. Inner jacket 100 provides adjustable cuffs 170 and 171 to give better fit. Added protection from the rain or wind is provided by collapsible hood 150, which is located inside collar 127. Collapsible hood 150 is accessed by opening zipper 151 and pulling out collapsible hood 150.

Inner jacket 100 may contain or be formed of body armor material, in whole or in part, in front or back, in place of or in conjunction with vest 10 body armor fabric. Thus, inner jacket 100 could be all or partially protected with body armor material, e.g. to cover portions of areas of the body which need such protection, which are not protected by a particular body armor material-containing vest 10 configuration, or alternatively, give double layer protection in critical areas, e.g. heart and lungs.

Likewise, by the same logic as above, outer jacket 300 may include in all, a portion, or none of its construction, body armor material, and work in conjunction with, or in place of body armor material of vest 10 and/or inner jacket 100.

By using various configurations of vest 10, inner jacket 100 and outer jacket 300, desired levels of protection are achieved to provide improved, diverse body armor for all law enforcement personnel and others in need of such protection, extending the areas of the body protected, extending the layering and protection level possibilities, and extending the weather conditions in which such protection is achieved.

The use of outer jacket 300 in connection with vest 10 and inner jacket 100 is now described.

Figure 6:
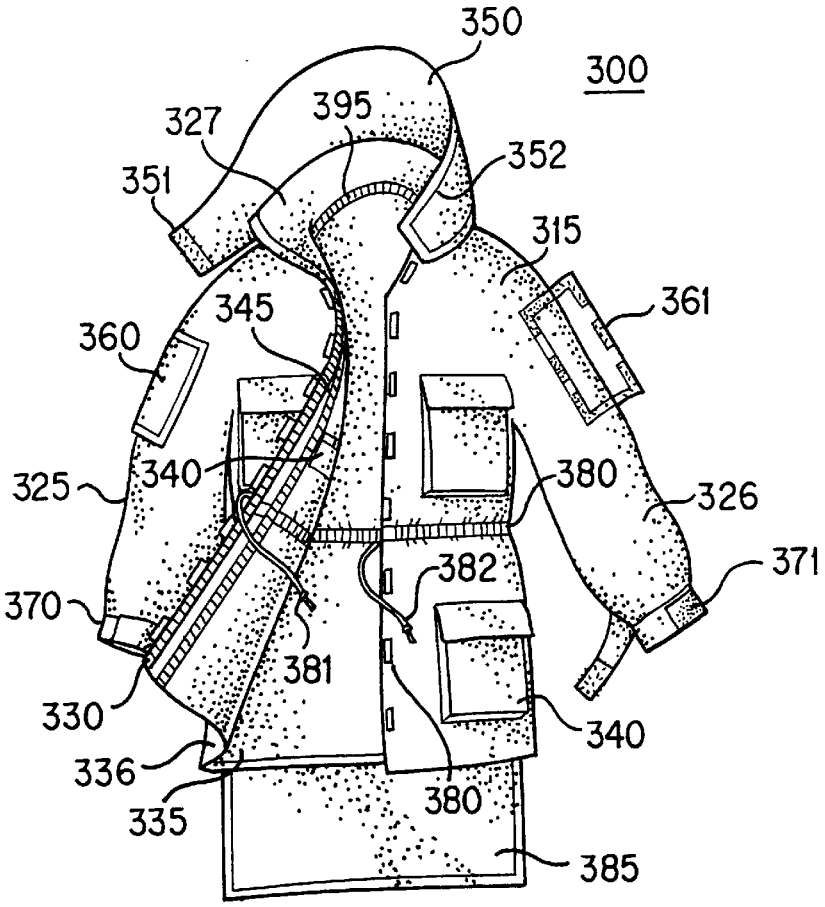
FIG. 6 shows a front view of an embodiment of the outer jacket of the present invention.
Figure 7:
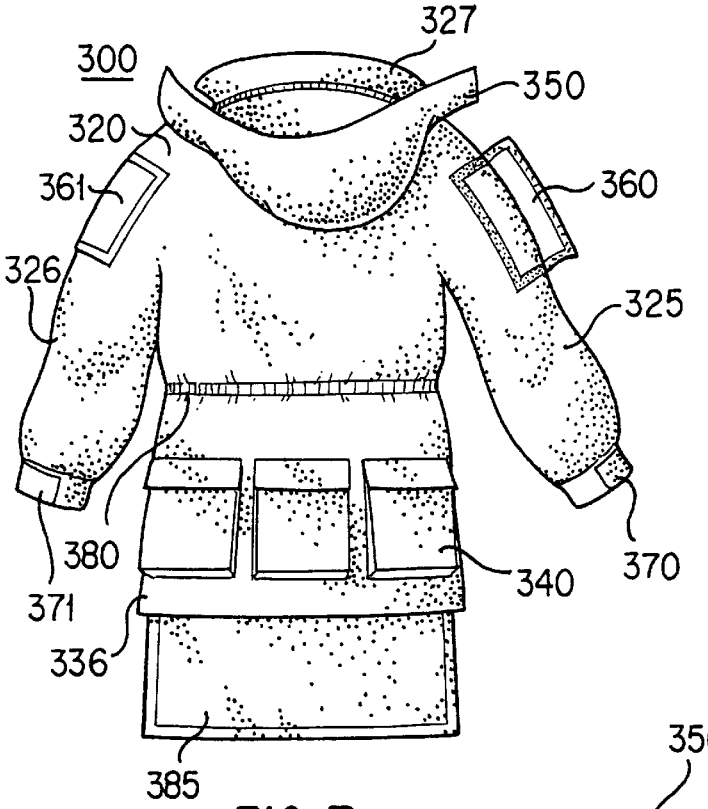
FIG. 7 shows a rear view of the embodiment shown in FIG. 6.

As mentioned above, inner jacket 100 can be attached to vest 10 and/or to outer jacket 300 (as shown in FIGS. 6 and 7). Note that identical parts are identically numbered in FIG. 5. Referring now to FIG. 5, attachment to vest 10 to form a first composite jacket 200 is done my mating snaps 90 to snap complements 190. This first requires that vest 10 be turned inside out and then be snapped to inner jacket 100. As a result, pockets 40 of vest 10 become the internal pockets 240 of first composite jacket 200 and the external pockets 241 are pockets 140 of inner jacket 100. First composite jacket 200 therefore has pockets lining both sides of jacket 200. This feature increases the carrying capacity and usefulness of first composite jacket 200. Attachment to outer jacket 300 is accomplished via continuous fastener 195, which extends along the entire outer seam of inner jacket 100, including along collar 127. Continuous fastener 195 thus provides a complete seal between inner jacket 100 and outer jacket 300. This provides the most complete seal between inner jacket 100 and outer jacket 300.

Referring now to FIGS. 6 and 7, a front and rear view of outer jacket 300 is shown. Outer jacket 300 has a front panel 315, a rear panel 320, a pair of sleeves 325 and 326, and a collar 327. Front panel 315 has a fastener 330 for opening and closing outer jacket 300. Front panel 315 and rear panel 320 further have an inner surface 335 and an outer surface 336. A plurality of pockets 340 cover inner surface 335 and outer surface 336. More storage area is provided by placing a pair of pockets 360 and 361 on sleeves 325 and 326, respectively. Pockets 360 and 361 are accessed from the side. Pockets 340, some of which are located on the bottom of outer surface 336 of front panel 315, also have side access. Outer jacket 300 also has seam pockets 345, which as the name implies, are along the seam of outer jacket 345 and are used to carry pens, whistles and other such items.

Outer jacket 300 provides adjustable cuffs 370 and 371 to give better fit and comfort. Added protection from the rain, snow or wind is provided by detachable hood 350, which is attachable at a base of collar 327 with filamentary loop and hook mechanisms, zipper, snaps or other similar detachable mechanisms. Detachable hood 350 further has enclosures 351 and 352 which can be fastened together to prevent exposure of the face of the user from the cold. The user can also get a closer and snug fit by using drawstring 380, which has ends 381 and 382, to tighten outer jacket 300 around the user. More added protection to the user if provided by detachable apron 385. Detachable apron 385 allows the user to sit safely and/or drily on wet and/or cold benches and other like areas. It also helps reduce the amount of water and/or air that may hit the user's legs and/or flow up the back of outer jacket 300. Detachable apron 385 is preferably attached to the interior, bottom surface of rear panel 320 using releasable attachment mechanisms. Flaps 380 are provided on front panel 315 to additionally seal outer jacket 300 and fits over fastener 330. Throughout this description, detachable generally indicates the preferred usage of filamentary loop and hook mechanisms to attach/detach the item of interest. Other similar mechanisms can be used.

Figure 8:
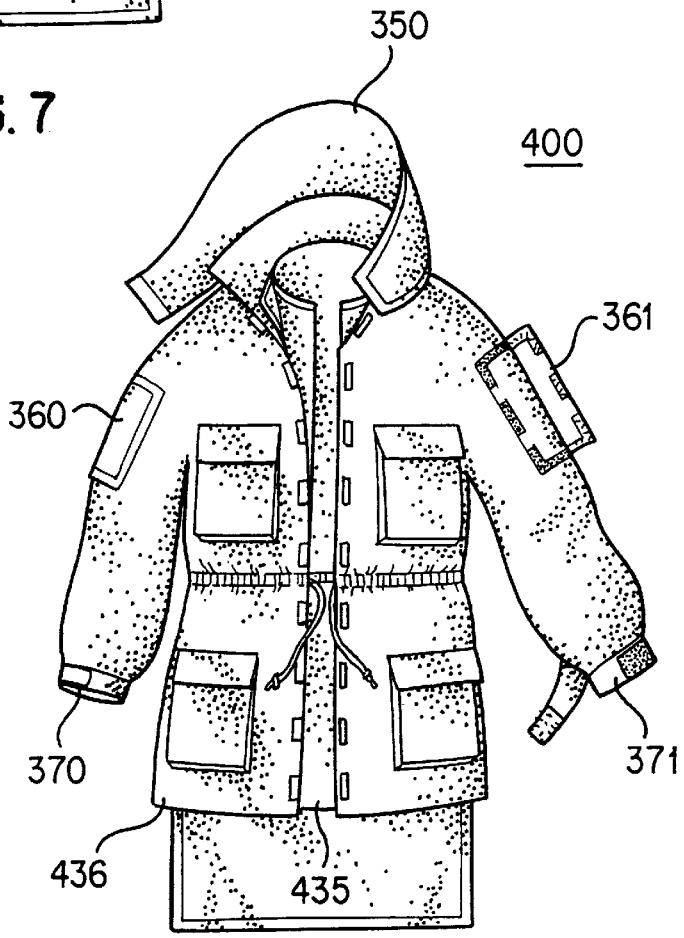
FIG. 8 shows a front view of an embodiment of a combined, vest inner jacket and outer jacket of the present invention.

As stated above, outer jacket 300 can be connected to first composite jacket 200 to form a second composite jacket 400, which would then have a three layer construction. Outer jacket 300 could also be connected to inner jacket 100 to form a two layer jacket. Outer jacket 300 has a complementary continuous fastener 395 which extends along the outer seam of outer jacket 300 including the neck portion. Referring to FIG. 8, when continuous fastener 195 and complementary continuous fastener 395 are joined, second composite jacket 400 is assembled. In this combination, inner surface 35 of vest 10 becomes an inner surface 435 of second composite jacket 400 and outer surface 336 of outer jacket 300 becomes an outer surface of second composite jacket 400. As a consequence, second composite jacket 400 has pockets on all surfaces and has three layers of material for thermal insulation.

Vest 10, inner jacket 100 and outer jacket 300 are preferably constructed out of materials which provide protection from wet, windy, cold conditions or a combination thereof, as well as the body armor materials described above. Vest 10, since it is primarily for the summer, is preferably constructed from nylon, light canvas, cotton and other such materials in conjunction with the body armor material, or even constructed of flexible body armor material alone. A water resistant and/or repellant material may be used or coated on. The object is to make it light and comfortable, but also useful. Inner jacket 100 is preferably constructed from polyester, nylon, polyethylene, polypropylene, water repellant materials and water resistant materials. In addition, inner jacket 100 could also use thermally insulating materials on the exterior surfaces and/or as inner insulation. The inner facing surfaces could in addition to the above, be constructed from fleece, wool, cotton or a combination of any the above listed materials. Again, the object is to keep the weight to a minimum, but provide effectivity against the weather. Outer jacket 300 is constructed similarly to inner jacket 100.

Obviously, numerous modifications and variations of the present invention are possible in light of the above teachings. It is therefore understood that within the scope of the appended claims, the invention may be practiced otherwise than as specifically described herein.

What is claimed is:

1. The modular bullet-proof vest which comprises (a) a vest having a vest front panel, a vest rear panel and a pair of armholes, said vest having a first fastening means for opening and closing said vest;

(b) said vest front panel and said vest rear panel each having an inner surface and an outer surface;

(c) a first plurality of pockets covering said outer surface of said vest front panel and said vest rear panel; and, (d) means for releasably attaching a pair of detachable sleeves to said pair of armholes;

(e) an inner jacket having a front panel, a rear panel and a pair of sleeves, said front panel having a second fastening means for opening and closing said inner jacket;

(f) said front panel and said rear panel each having an interior surface and an exterior surface;

(g) said exterior surface of said rear panel having a pouch;

(h) a second plurality of pockets covering said pouch and said exterior surface of said front panel and said rear panel;

(i) said inner jacket having a collar, said collar having means for containing a collapsible hood;

(j) said vest having a third fastening means for fastening said vest to said inner jacket through a complementary fastening means located on said inner jacket, said vest fastened to said inner jacket and being a combination to one another and further forming a first composite jacket; and, (k) said first composite jacket having an outside surface and an inside surface, wherein said outside surface is said exterior surface of said front panel of said inner jacket and said rear panel of said inner jacket and said inside surface is said outer surface of said vest front panel and said vest rear panel.

2. A multi-compartment, modular garment comprising:

(a) a vest having a first means for opening and closing, an inner surface, an outer surface, and a means for releasably attaching a pair of detachable sleeves to said vest;

(b) a first plurality of pockets covering said outer surface;

(c) an inner jacket having a pair of sleeves, a second means for opening and closing, an interior surface and an exterior surface;

(d) said exterior surface having a pouch on a back portion of said inner jacket;

(e) a second plurality of pockets covering said pouch and s aid exterior surface;

(f) means for fastening said vest to said inner jacket, said vest fastened to said inner jacket forming a composite jacket wherein an outside surface of said composite jacket is said exterior surface of said inner jacket and an inside surface of said composite jacket is said outer surface of said vest;

(g) an outer jacket having a first pair of sleeves, a third means for opening and closing, an internal surface, and an external surface;

(h) a third plurality of pockets covering said external surface and said internal surface;

(i) means for enclosingly fastening said outer jacket to said inner jacket, said means for enclosingly fastening extending around an outer seam of said inner jacket and said outer jacket, wherein an innermost surface is said outer surface of said vest and outermost surface is said external surface of said outer jacket;

wherein at least one of said vest, said inner jacket and said outer jacket, at least in part, contains flexible body armor sufficient to prevent body penetration by at least one recognized threat level of ballistic performance projectiles.

3. The garment as recited in claim 1, wherein said vest front panel contains flexible body armor.

4. The modular bullet-proof vest of claim 3 wherein said front panel and said rear panel are joined below said pair of armholes and said flexible body armor extends for substantially the full area formed by said front panel.

5. The modular bullet-proof vest of claim 3 wherein said vest has a first fastening means located in its front panel.

6. The modular bullet-proof vest of claim 3 wherein said vest has a first fastening means located at a seam between said front panel and said rear panel.

7. The modular bullet-proof vest of claim 3 wherein said vest has a first fastening means located in its rear panel.

8. The modular bullet-proof vest of claim 3 wherein said first fastening means is covered by a flexible flap having a rest position against and covering said first fastening means, and said flexible flap contains flexible body armor.

9. The modular bullet-proof vest of claim 2 wherein said inner jacket contains flexible body armor at least in its front.

10. The modular bullet-proof vest of claim 3 wherein said outer jacket contains at least a strip of flexible body armor located so as to cover at least the fastening means of said vest.

11. The modular bullet-proof vest of claim 9 wherein said outer jacket contains at least a strip of flexible body armor located so as to cover at least the fastening means of said inner jacket.

* * * * *